US005966878A

United States Patent [19]

Freund

[11] Patent Number: 5,966,878

[45] Date of Patent: Oct. 19, 1999

[54] WINDOW INSTALLATION SUPPORT BRACKET

[76] Inventor: Theodore Freund, 5418 47th St., Stony Plain, Canada, T7Z 1E4

[21] Appl. No.: 09/017,598

[22] Filed: Feb. 3, 1998

[51] Int. Cl.[6] ..... E04B 1/38

[52] U.S. Cl. ..... 52/127.2; 52/712; 52/DIG. 1; 52/702; 52/745.16; 248/300; 269/904

[58] Field of Search ..... 52/712, 702, 127.2, 52/745.09, 745.1, 745.13, 745.15, 745.16, DIG. 1; 248/300; 24/563, 456; 269/904

[56] References Cited

U.S. PATENT DOCUMENTS

| | | | |
|---|---|---|---|
| D. 343,112 | 1/1994 | Corbin . | |
| D. 360,355 | 7/1995 | Adams . | |
| 1,391,688 | 9/1921 | Marsico | 248/300 |
| 1,501,807 | 7/1924 | Petschel . | |
| 2,789,782 | 4/1957 | Huth | 248/300 X |
| 4,089,141 | 5/1978 | Heroux | 52/DIG. 1 X |
| 4,201,215 | 5/1980 | Crossett et al. | 24/456 X |
| 4,794,675 | 1/1989 | Bisconti | 24/456 X |
| 5,058,358 | 10/1991 | Stratton | 52/702 |
| 5,118,059 | 6/1992 | Mainer . | |
| 5,384,938 | 1/1995 | Frederick | 24/563 X |
| 5,396,707 | 3/1995 | Blase . | |
| 5,572,830 | 11/1996 | Freeman | 49/506 X |

FOREIGN PATENT DOCUMENTS

| | | |
|---|---|---|
| 0 562 324 A1 | 3/1993 | European Pat. Off. . |
| WO 88/01670 | 9/1987 | WIPO . |

*Primary Examiner*—Robert Canfield
*Attorney, Agent, or Firm*—Theodore Freund

[57] ABSTRACT

A bracket, for facilitating installation of window units, has a support arm and a lower arm, parallel to and spaced apart from each other, and interconnected by a transitional section. Two or more brackets may be used during installation of a window. The lower arm of each bracket is positioned under the sill member, so that the transitional section comes close to the interior edge of the sill member, and each support arm passes over, and cantilevers beyond, the sill member. The window being installed may then be temporarily supported on the cantilevering support arms. Retainers such as screwdrivers may be positioned in holes provided near the ends of the support arms to prevent the window from sliding off the support arms. The brackets may be nailed or screwed to the sill member through holes provided in the transitional sections.

8 Claims, 1 Drawing Sheet

WINDOW INSTALLATION SUPPORT BRACKET

FIELD OF INVENTION

The present invention relates to means for temporary support of pre-manufactured windows during installation of same in framed openings in building walls.

BACKGROUND OF INVENTION

The installation of a window typically entails lifting the window up to the vicinity of the window opening, and then manually manoeuvring the window into the desired position in the opening. This can be a difficult and time-consuming procedure, particularly with heavy window units. It can also be hazardous, because if the workers installing the window lose their grip on the window before it has been securely anchored into position, the window can fall to the ground, injuring the workers and others on the ground. This hazard is naturally greater when windows are being installed in multi-level buildings.

One example of an attempt to address these problems is found in PCT Application PCT/W088/01670 (Harrison). This invention provides a lifting harness to be fitted to the window being installed, whereupon the window is hoisted up to and into the window opening by means of a winch mounted to a winch frame positioned inside the building. The risk of the window falling to the ground is considerably reduced or eliminated by the hoist and its associated lifting line, which should remain attached to the lifting harness until the window has been anchored in position. However, the Harrison invention is a complicated apparatus involving numerous components, including moving parts which may wear out. The Harrison apparatus has the further disadvantage of requiring a complicated procedure in operation, both during hoisting and installation of the window, and in dismantling the apparatus after the window has been positioned.

There is therefore a need in the art for a window installation support means which is simple and easy to use, has a minimal number of components, and is simple and economical to manufacture. In particular, there is a need for such a device adapted for use in conventional wood frame building construction wherein the framework for the window openings includes a sill member.

SUMMARY OF THE INVENTION

The present invention provides a one-piece bracket, two or more of which may be conveniently positioned in a framed opening to support a window unit during installation.

In one aspect, the invention comprises a support bracket of unitary construction, for use in installing a window into a framed window opening having a sill member, comprising:

(a) an elongate support arm;

(b) an elongate lower arm, said lower arm being disposed directly below and substantially parallel to the support arm, and spaced apart therefrom by a distance substantially equal to the thickness of the sill member; and (c) a transitional section connecting one end of the support arm to one end of the lower arm;

whereby the bracket may be slid over the sill member, with the support arm above the sill member and the lower arm under the sill member.

In the preferred embodiment, the support arm, lower arm, and transitional section will be formed of flat stock, so as to provide increased surface area for supporting a window. The transitional section preferably will have a pre-formed hole to receive a fastener, such as a nail or screw, to secure the bracket to the sill member during use. As well, the support arm preferably will have a pre-formed hole in which a retainer such as a screwdriver may be inserted.

In another aspect, the invention is a method of installing a window into a framed window opening having a sill member, said method comprising the steps of:

(a) installing two or more "J" shaped support brackets each having a long support arm and a short lower arm over the sill member, such that:

(i) the support arm of the bracket is horizontal and rests for part of its length on the sill member;

(ii) part of the support arm cantilevers beyond the sill member; and (iii) the lower arm being positioned under the sill member;

(b) using the cantilevering portion of the support arms to support the weight of the window while manoeuvring the window into place in the window frame; and (c) affixing the window to the window opening.

BRIEF DESCRIPTION OF THE DRAWINGS

The preferred embodiment of the invention will now be described with reference to the accompanying drawings, in which.

DETAILED DESCRIPTION OF THE INVENTION

Figure 1:
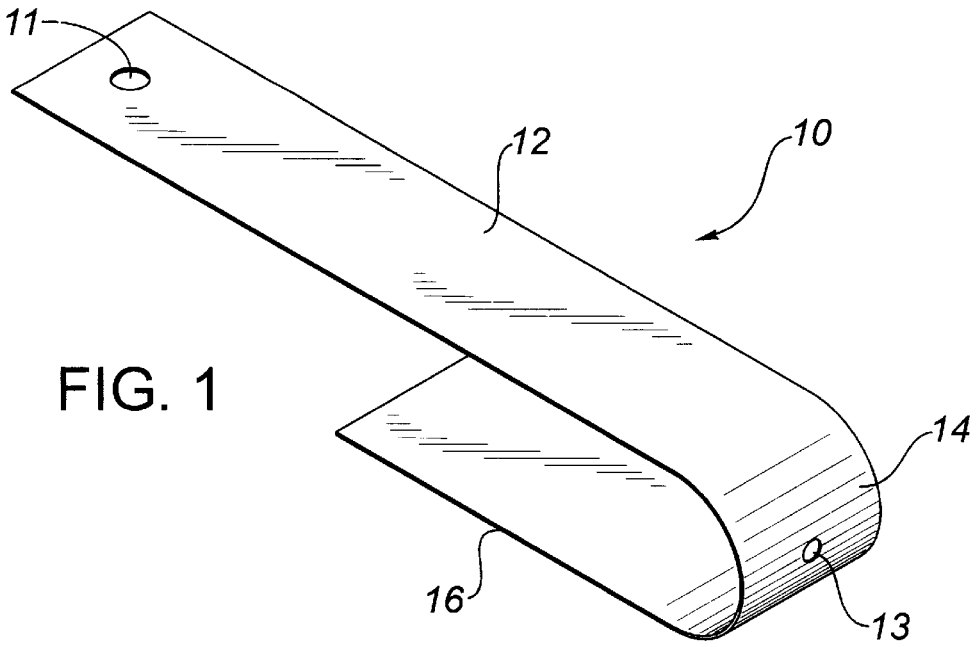
FIG. 1 is an isometric view of the bracket of the present invention.

Referring to FIG. 1, the present invention, generally represented by reference number (10), comprises a support arm (12), a lower arm (16), and a transitional section (14) connecting the support arm (12) to the lower arm (16). In the preferred embodiment, the transitional section (14) has a fastener hole (13), and the support arm (12) has a retainer hole (11) near its end to receive a retainer such as a screwdriver. The support arm (12) is substantially parallel to lower arm (16), with the space between them selected to match the thickness of framing members used in a window opening.

Figure 2:
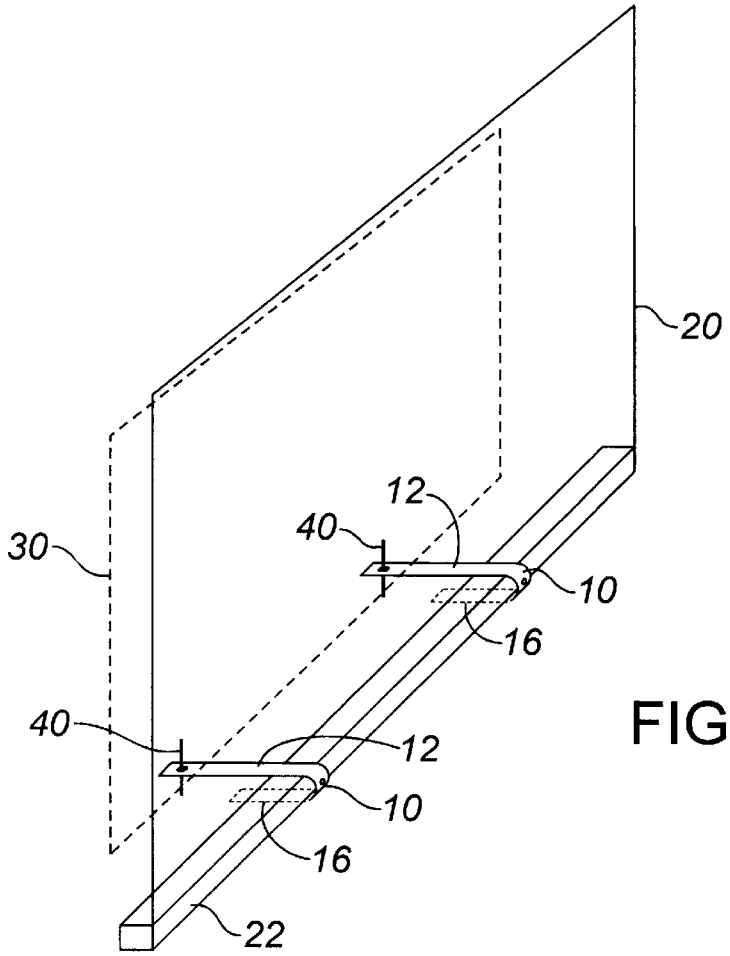
FIG. 2 is an isometric view of two of the brackets mounted in a framed window opening and supporting a window unit during installation of same.

Referring to FIG. 2, two of the brackets (10) of the present invention are shown installed in a window opening, generally represented by reference number (20), with the brackets (10) being mounted over and around the sill member (22) of the window opening (20). The lower arm (16) of each bracket (10) passes underneath the sill member (22), while the support arms (12) of the brackets (10) extend in cantilever fashion beyond the sill member (22). Fasteners (not shown), such as nails, may be inserted into the fastener holes (13) to anchor the brackets (10) to the sill member (22).

It may be readily seen from FIG. 2 that a window unit, generally represented by reference number (30), may be supported on the cantilevering ends of the support arms (12) of the brackets (10). It may also be readily seen from FIG. 2 that a retainer (40), such as a screwdriver, may be inserted in hole (11) in each support arm (12) to act as a stop, preventing the window (30) from sliding off the ends of the support arms (12). In the preferred mode of using the invention, workers may position the window unit (30) onto the support arms (12) of the brackets (10) by sliding the window unit (30) outwardly through the window opening (20), with the top of the window unit (30) being tilted outward during this procedure. When the window unit (30) has passed completely through the window opening (20), it may be tilted back to a substantially vertical position, with the bottom of the window unit (30) resting on the support arms (12) of the brackets (10). With the window (30) being supported by the brackets (10), as shown in FIG. 2, workers may slide the window (30) into the desired position within the window opening (20), without having to exert any physical effort holding up the window (30).

After the window (30) has been anchored to the framing of the window opening (20), the brackets (10) may be easily removed from the sill member (22). In the preferred embodiment, the transitional section (14) of each bracket is curvilinear, as illustrated in FIG. 1, such that a semi-cylindrical space is formed between the transitional section (14) and the sill member (22) when the bracket (10) is installed as described previously. A hammer claw or other convenient implement may be inserted into the semi-cylindrical space and then used in prying fashion to assist in removing the bracket (10) from the sill member (22).

Variations and modifications of the disclosed preferred embodiment and alternative embodiments will be apparent to skilled practitioners. All such variations and modifications are intended to be encompassed by the claims set forth herein.

The embodiments of the invention in which an exclusive property or privilege is claimed are defined as follows:

1. A support bracket of unitary construction, for use in installing a window into a framed window opening having a sill member, comprising:

(a) an elongate support arm;

(b) an elongate lower arm, said lower arm being disposed directly below and substantially parallel to the support arm, and spaced apart therefrom; and (c) a curvilinear transitional section connecting one end of the support arm to one end of the lower arm, said transitional section having a hole through its thickness at a point between the support arm and the lower arm;

whereby the bracket may be slid over the sill member, with the support arm above the sill member and the lower arm under the sill member.

2. The support bracket of claim 1 wherein the support arm has a hole through its thickness at a point near its end farthest from the transitional section.

3. The support bracket of claim 1 wherein the support arm is longer than the lower arm.

4. A method of installing a window into a window opening having a sill member, said method comprising the steps of:

(a) installing onto the sill member, two or more support brackets each having a long support arm, a short lower arm, and a transitional section connecting one end of the support arm to one end of the lower arm, such that:

(i) the support arm of the bracket is horizontal and rests for part of its length on the sill member;

(ii) part of the support arm cantilevers beyond the sill member; and (iii) the lower arm is positioned under the sill member;

(b) using the cantilevering portion of the support arms to support the weight of the window while manoeuvring the window into place in the window frame; and (c) affixing the window within the window opening.

5. The method of claim 4 wherein the transitional section of each support bracket has a hole through its thickness at a point between the support arm and the lower arm, and further comprising the step of fastening each support bracket to the sill member using a fastener such as a nail or screw installed through said hole.

6. The method of claim 4 wherein each support arm has a hole near its cantilevering end, and further comprising the step of inserting a retainer in said hole to prevent the window from sliding off the end of the support arm.

7. The method of claim 4 wherein the transitional section is curvilinear.

8. A support bracket of unitary construction, for use in installing a window into a framed window opening having a sill member, comprising:

(a) an elongate support arm, having a hole through its thickness for receiving a retainer;

(b) an elongate lower arm, said lower arm being shorter than the support arm, disposed directly below and substantially parallel to the support arm, and spaced apart therefrom; and (c) a transitional section connecting one end of the support arm to one end of the lower arm, said transitional section being curvilinear and having a hole through its thickness for receiving a fastener;

whereby the bracket may be slid over the sill member, with the support arm above the sill member and the lower arm under the sill member, and the bracket may be fastened to the sill member using a fastener installed through said hole in the transitional section.

* * * * *